US006683401B2

(12) United States Patent
Gorog et al.

(10) Patent No.: US 6,683,401 B2
(45) Date of Patent: Jan. 27, 2004

(54) WELD-FREE MASK SUPPORT BLADE STRUCTURE

(75) Inventors: Istvan Gorog, Lancaster, PA (US); Walter David Masterton, Lancaster, PA (US); Alan Weir Bucher, Manheim, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 107 days.

(21) Appl. No.: 09/880,196

(22) Filed: Jun. 13, 2001

(65) Prior Publication Data

US 2002/0190627 A1 Dec. 19, 2002

(51) Int. Cl.[7] ..... H01J 29/80
(52) U.S. Cl. ..... 313/407; 313/402
(58) Field of Search ..... 313/402–408, 313/477 R, 407

(56) References Cited

U.S. PATENT DOCUMENTS 4,748,370 A * 5/1988 van den Broek ..... 313/404
5,424,603 A * 6/1995 Van Den Bekerom ..... 313/407
6,479,925 B1 * 11/2002 Kim ..... 313/402
6,509,679 B1 * 1/2003 Ligthart et al. ..... 313/407
2002/0101149 A1 * 8/2002 Reed et al. ..... 313/407
2002/0125809 A1 * 9/2002 Wilk ..... 313/407

FOREIGN PATENT DOCUMENTS

JP 57096448 A * 6/1982 ..... H01J/29/80

* cited by examiner

*Primary Examiner*—Nimeshkumar D. Patel
*Assistant Examiner*—German Colón
(74) *Attorney, Agent, or Firm*—Joseph S. Tripoli; Carlos M. Herrera; Patricia A. Verlangieri

(57) ABSTRACT

The present invention provides an improved tension mask frame assembly 10 in which mask support members 40 are provided with side walls 42, 46 and a back wall 44 that are held together primarily by means of either tabs formed along an edge of the back wall 48 received into respective apertures 50 in the side wall 42 or by means of a ridge 69 formed in the side wall 62 which abuts the back wall 64.

15 Claims, 6 Drawing Sheets

FIG. 5
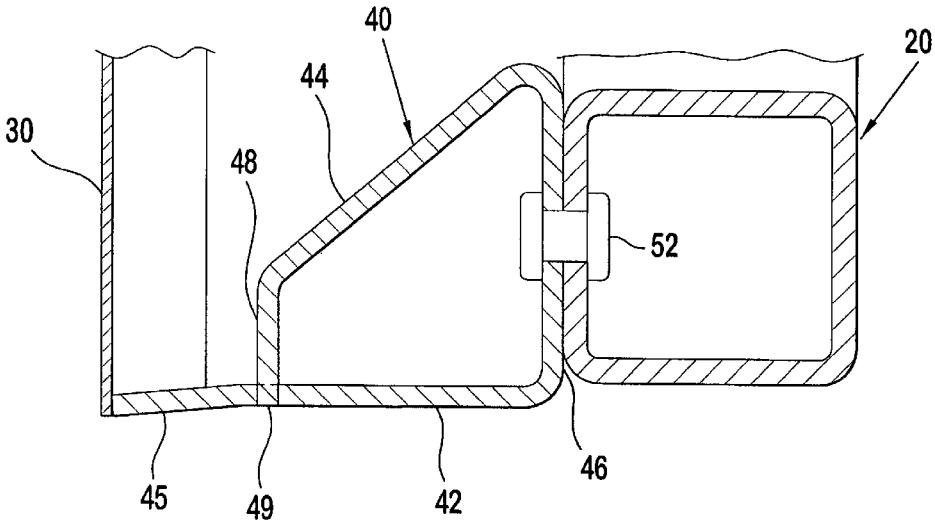
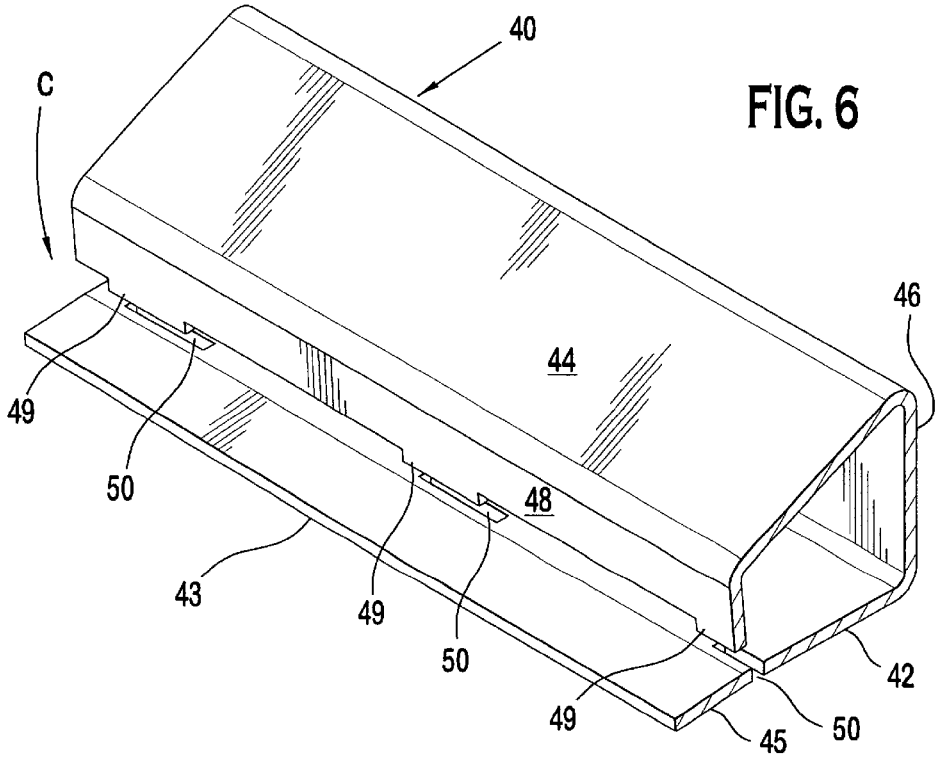
FIG. 6

WELD-FREE MASK SUPPORT BLADE STRUCTURE

FIELD OF THE INVENTION

This invention relates to color picture tubes having tension masks, and more particularly to a tension mask assembly having support members for connecting the tension mask to a frame.

BACKGROUND OF THE INVENTION

A cathode ray tube (CRT) includes an electron gun for generating and directing three electron beams to the screen of the CRT. The screen is located on the inner surface of a faceplate panel of the CRT and is made up of an array of elements of three different color emitting phosphors. A color selection electrode, which may be either a shadow mask or a focus mask, is interposed between the gun and the screen to permit each electron beam to strike only the phosphor elements associated with that beam.

Recently, the CRT having a flatter faceplate panel has become more desirable. As the CRT becomes flatter, so does the need for flatter shadow masks. Such flat shadow masks tend to be prone to vibration, or microphonics, during tube operation, which adversely affects the display screen of the CRT. In order to reduce microphonics, the shadow mask is stretched and welded to support members. The support members are secured to a frame and assist in maintaining tension on the shadow mask. These types of mask that are stretched are commonly referred to as tension-type shadow masks.

The mask frames and support members used to support the tension shadow masks maybe advantageously constructed of sheet metal structures welded together to provide means for supporting the tension mask. The fabrication of such structures is often labor extensive and a relatively costly operation as a result of the many welds needed to strengthen the support members. The welding operation also subjects the support members to thermal expansions that may distort the support members affecting the placement of the mask with respect to the screen. Furthermore, during CRT manufacture, the tension mask-frame assembly is exposed to temperatures reaching or exceeding approximately 460° C. At temperatures of this magnitude, the weld joints are subject to the potential of fatigue crack initiation at high stress points.

SUMMARY OF THE INVENTION

The present invention therefore provides an improved tension mask frame assembly in which mask support members are provided with side walls and a back wall that are held together without the need for welding.

Embodiments of the invention are provided in which the side walls and a back wall of the mask support member are attached to each other by a ridge on one side wall engaging the back wall. Alternatively, the back wall of the support member has tabs formed along an edge whereby each tab is received by a respective aperture preferably formed therethrough or is received between multiple ridges to secure the back to the sides producing a closed support member. In addition, the tabs are secured to the side walls, by engagement with the aperatures, such that any two adjacent walls are restricted from shifting resulting in a mask support member that is torsionally stiff.

BRIEF DESCRIPTION OF THE DRAWINGS

The invention will now be described by way of example with reference to the accompanying figures of which:

FIG. 5 cross sectional view taken along the line 5—5 of FIG. 4.

FIG. 6 is a perspective view of the support blade structure during assembly.

DETAILED DESCRIPTION OF THE INVENTION

Figure 1:
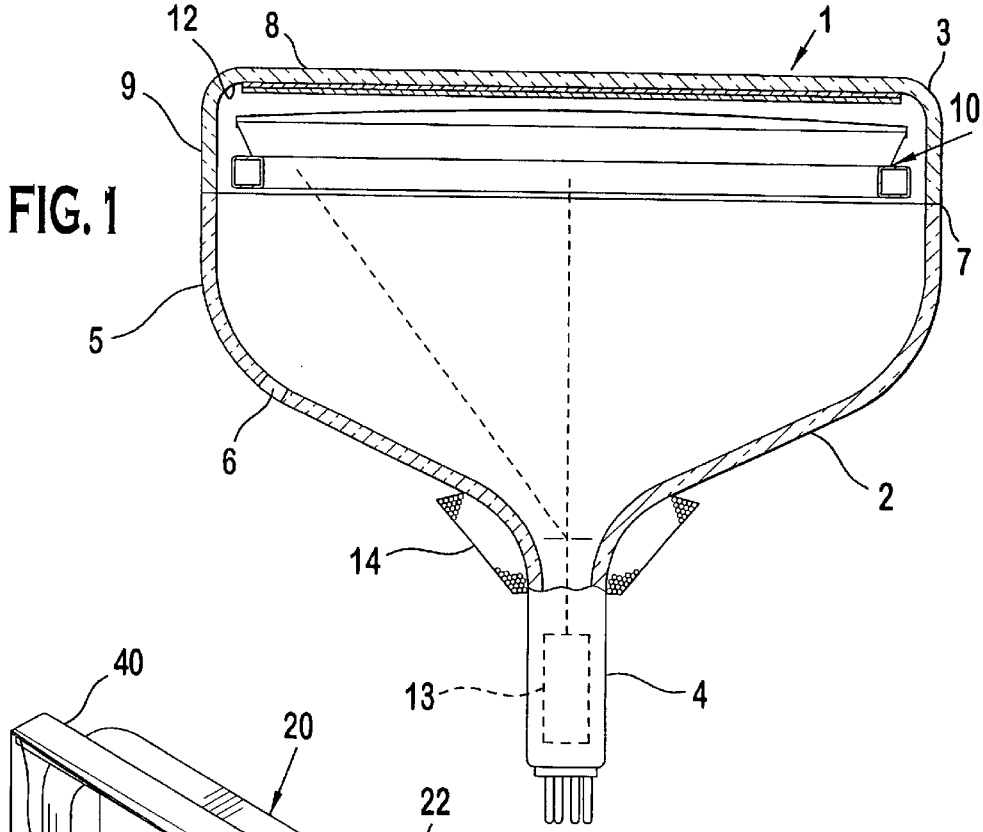
FIG. 1 is a cross sectional view of a color picture tube having a tension mask frame assembly mounted behind the faceplate panel.

FIG. 1 shows a color picture tube 1 having a glass envelope 2 comprising a faceplate panel 3 and a tubular neck 4 connected by a funnel 5. The funnel 5 has an internal conductive coating (not shown) that extends from an anode button 6 toward the panel 3 and to the neck 4. The panel 3 comprises a viewing faceplate 8 and a peripheral flange or sidewall 9, which is sealed to the funnel 5 by a glass frit 7. A three-color phosphor screen 12 is carried by the inner surface of the panel 3. The screen 12 is a line screen with the phosphor lines arranged in triads, each of the triads including a phosphor line of each of the three colors. A tension shadow mask assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask assembly 10 to the screen 12.

The tube 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
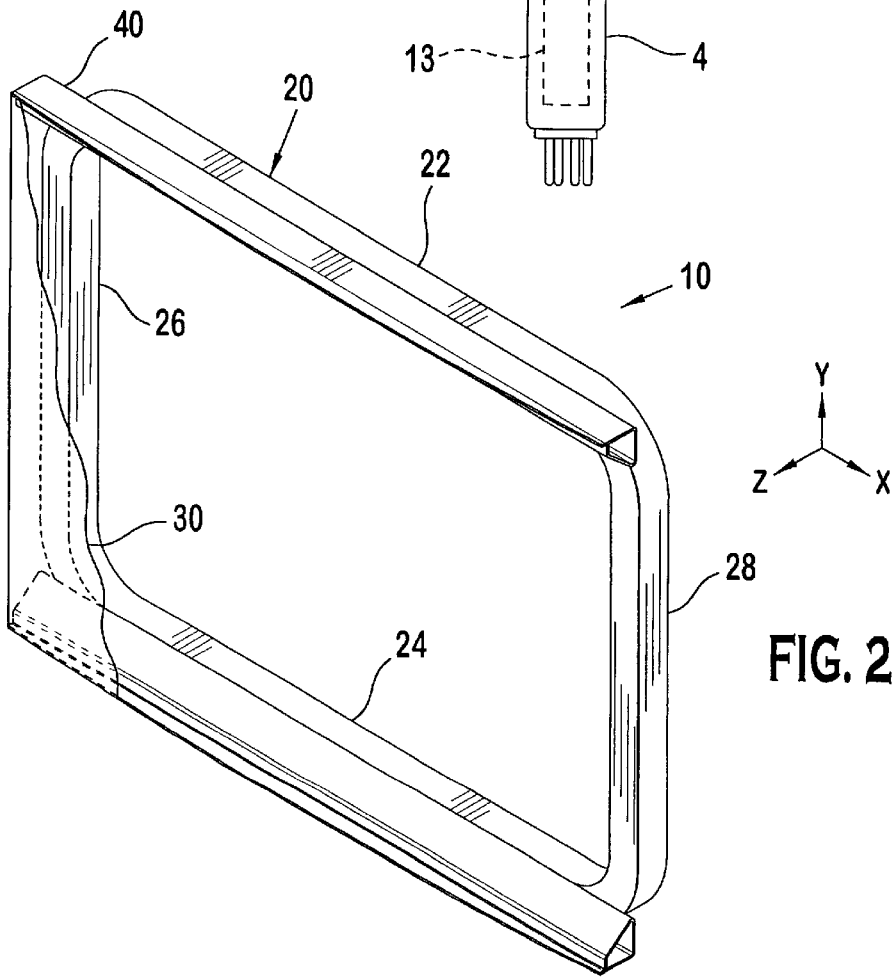
FIG. 2 is a perspective view of the tension mask frame assembly shown in FIG. 1.

The tension shadow mask assembly 10, as shown in FIG. 2, includes a frame 20 that further includes two long sides 22 and 24, and two short sides 26 and 28. The two long sides 22, 24 of the frame 20 are parallel to a central major axis, X, of the tube; and the two short sides 26, 28 parallel a central minor axis, Y, of the tube. The tension shadow mask assembly 10 includes an apertured shadow mask 30 that contains a plurality of metal strips (not shown) having a multiplicity of elongated slits (not shown) therebetween that parallel the minor axis of the shadow mask 30. The intermediate support member 40 is fastened to the frame 20 and may vary in height from the center to the ends of the support member 40 to permit the best curvature and tension compliance over the shadow mask 30.

Figure 3:
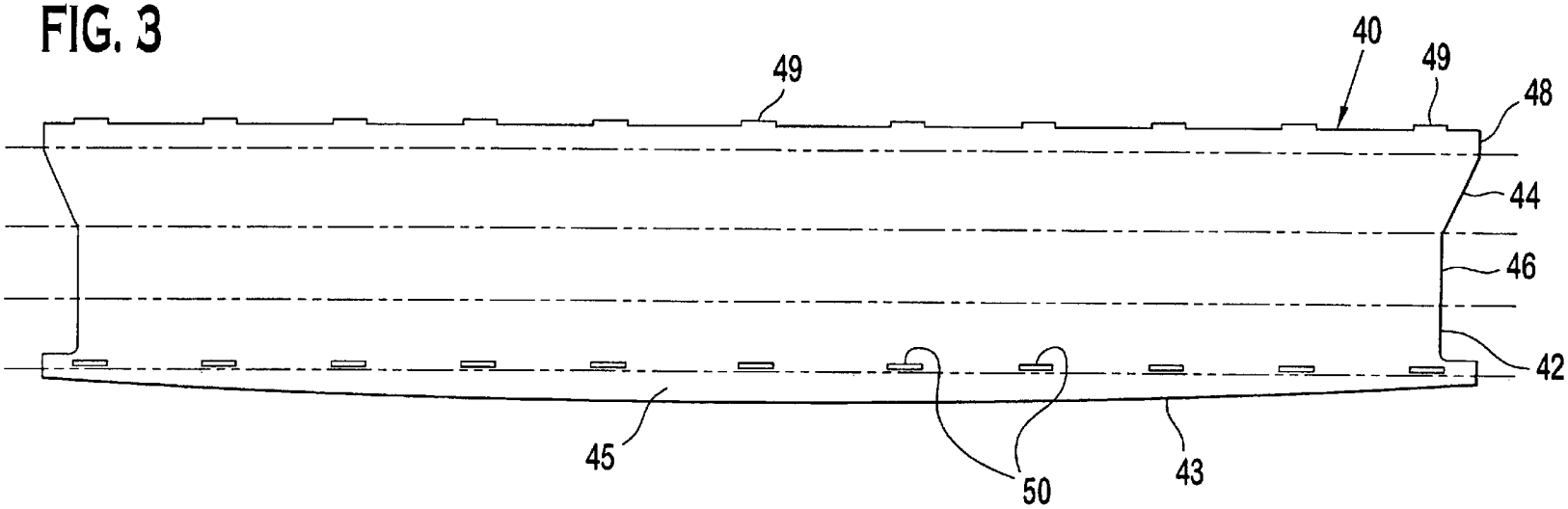
FIG. 3 is a top view of a sheet use to form a support blade structure for use in the tension mask frame assembly of FIG. 2.

Referring to FIG. 3, the intermediate support member 40 is formed from a sheet of metal which is creased along the dashed lines. The sheet is formed to have a plurality of side walls 42, 46 and a back wall 44. An angled portion 48 extends along the back wall 44. A mask receiving edge 43 is positioned along an end of the side wall extending portion 45. The mask receiving edge 43 may be suitably contoured to have the shadow mask 30 conform with the inner contour of the screen 12. A plurality of apertures 50 are formed in the side wall 42 near the crease line to the extending portion 45. The side wall 46 extends from the side wall 42 and further extends to the back wall 44. The angled portion 48 extends from the back wall 44 and is profiled to have a plurality of tabs 49 extending along its edge.

Figure 4:
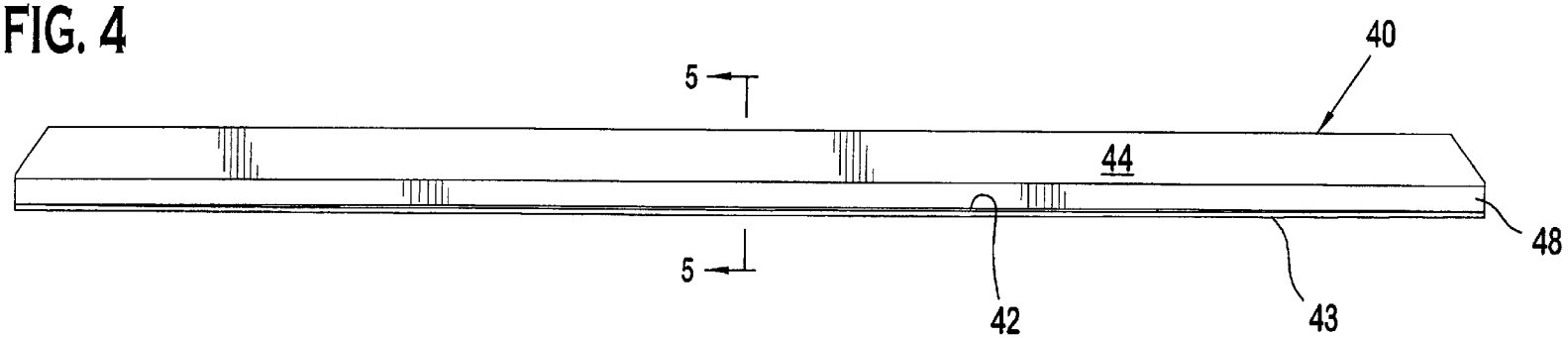
FIG. 4 is a front view of a portion of the support blade structure of FIG. 3.

FIG. 4 shows the intermediate support member 40 in the assembled position and FIG. 5 shows the intermediate support member 40 in the mounted position to the frame 20. In assembly, the sheet is formed such that each of the walls 42, 44, 46, and 48 are folded as shown in FIG. 6 along the dashed crease lines shown in FIG. 3 to form a closed tubular structure as best shown in the cross sectional view of FIG. 5. The back wall 44 is folded and urged toward the side wall 42 until the tabs 49 enter into the apertures 50. The apertures 50 are dimensioned to receive the tabs 49 in a tight fit. Once the tabs 49 are inserted into the apertures 50 to complete the intermediate support member 40, it is secured to the frame 20 as shown in FIG. 5. A fastener 52, or any other suitable support means, may be used to secure the intermediate support member 40 at side wall 46 to the frame 20. The shadow mask 30 is then applied to the mask receiving edge 43 to complete the tension shadow mask assembly 10. Once the tension mask 30 is applied to the mask receiving edge 43, a force cantilever is applied to the extending portion 45 thereby urging the side wall 42 against the angled portion 48 causing the intermediate support member 40 to remain correctly positioned.

Figure 7:
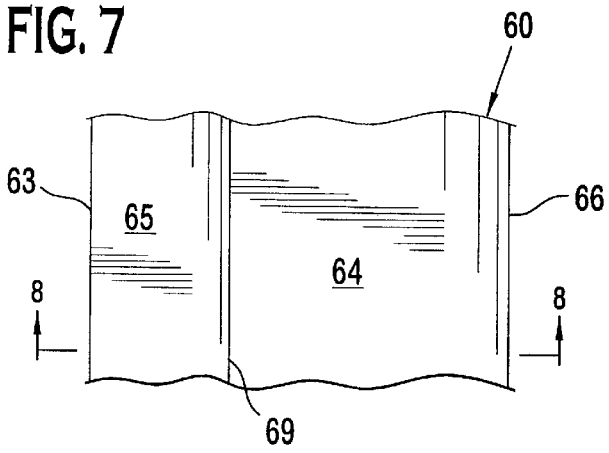
FIG. 7 shows a partial end view of a first alternate support blade structure.
Figure 8:
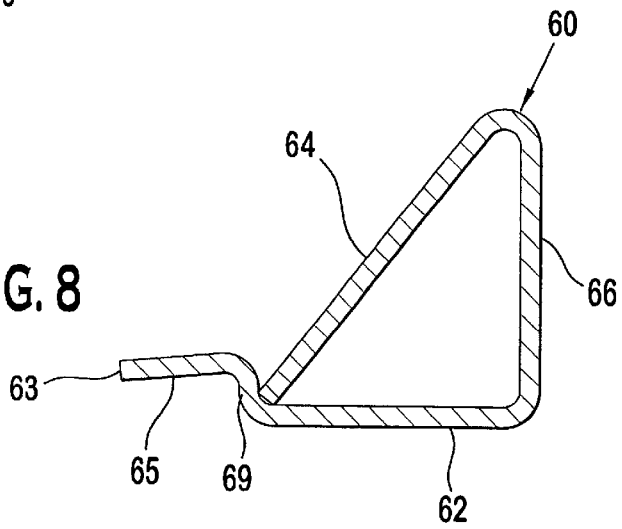
FIG. 8 shows a cross sectional view of the first alternate support blade structure taken along the line 8—8 of FIG. 7.

FIGS. 7 and 8 show a first alternate embodiment of an intermediate support member 60. This first alternate intermediate support member 60 is similar in that it has a side wall 62, a rear side wall 66, and an angled portion 65 extending along the side wall 62. A back wall 64, however, extends between side walls 62, 66 and is secured in a different manner. The back wall does not have tabs formed along its edge like the embodiment of FIGS. 3–6. Instead, a ridge 69 is formed in the side wall 62 just beneath the angled portion 65. The ridge 69 extends along the entire length of the intermediate support member 60, abuts an edge of the back wall 64 and serves to secure it against the side wall 62. This first alternate intermediate support member 60 is similarly secured to the frame 20 and similarly receives the shadow mask 30 along the mask receiving edge 63. Once the tension mask 30 is applied to the mask receiving edge 63, a force cantilever is applied to the extending portion 65 thereby urging the side wall 62 against the back wall 64. As the side wall 62 is urged against the back wall 64, the ridge 69 secures the back wall 64 in position to form the intermediate support member 40 as shown in FIG. 8 as a closed tubular structure.

Figure 9:
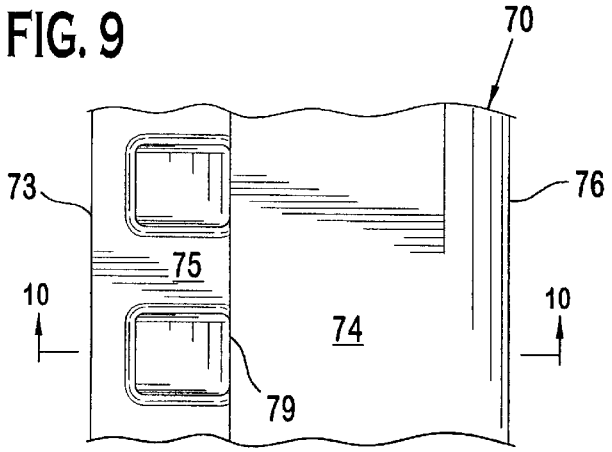
FIG. 9 shows a partial front view of a second alternate support blade structure.
Figure 10:
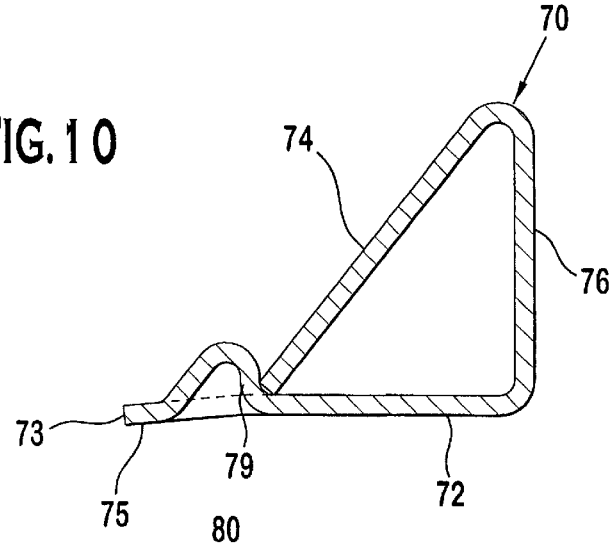
FIG. 10 is a cross sectional view of the second alternate support blade structure taken along the line 10—10 of FIG. 9.

FIGS. 9 and 10 show a second alternate embodiment of an intermediate support member 70. This second alternate intermediate support member 70 is similar in that it has a side wall 72, a rear side wall 76, and an extended portion 75 extending along the side wall 72. A back wall 74, however, extends between side walls 72, 76 and is secured to the side wall 72 in a yet another manner. The back wall 74 does not have tabs formed along its edge like the embodiment of FIGS. 3–6. Instead, a plurality of punched ridge portions 79 are formed in the side wall 72 along its length just beneath the extended portion 75. The punched ridge portions 79 abut an edge of the back wall 74 and serve to secure it against the side wall 72. This second alternate intermediate support member 70 is similarly secured to the frame 20 and similarly receives the shadow mask 30 along the mask receiving edge 73.

Figure 11:
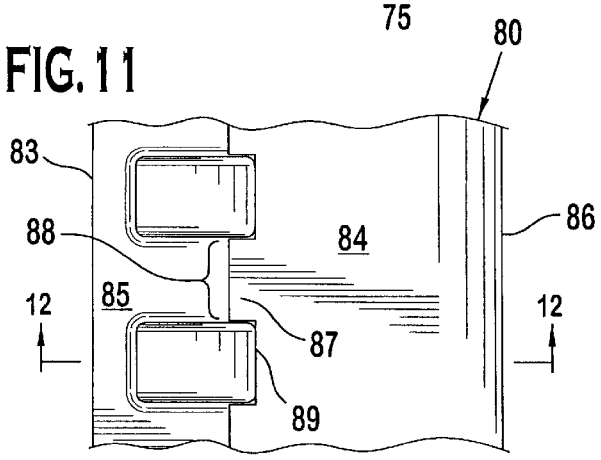
FIG. 11 shows a partial front view of a third alternate support blade structure.
Figure 12:
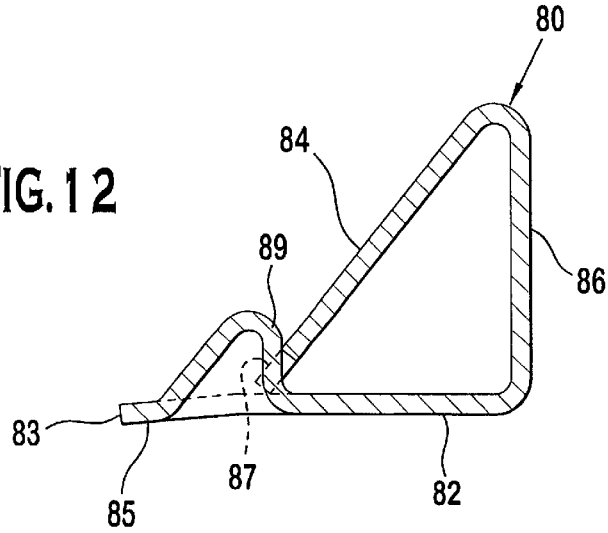
FIG. 12 is a cross sectional view of the third alternate support blade structure taken along the line 12—12 of FIG. 11.

FIGS. 11 and 12 show a third alternate embodiment of an intermediate support member 80. This third alternate intermediate support member 80 is similar in that it has a side wall 82, a rear side wall 86, and an extended portion 85 extending along the side wall 82. A back wall 84, however, extends between side walls 82, 86 and is secured to the side wall 82 in a yet another manner. Here, the back wall 84 has a plurality of tabs 87 formed along an edge similar to the embodiment of FIGS. 3–6. A plurality of punched ridge portions 89 are formed in the side wall 82 along its length just beneath the extended portion 85. The plurality of punched ridge portions 89 form apertures 88 therebetween for receiving a respective tab 87 along the edge of the back wall 84. The punched ridge portions 89 abut an edge of the bottom wall 84 and serve to secure it against the side wall 82. This third alternate intermediate support member 80 is similarly secured to the frame 20 and similarly receives the mask 30 along the mask receiving edge 83. This embodiment, like that of FIGS. 3–6, has an advantage in that because the tabs 87 are secured into apertures 88, side wall 82 and back wall 84 are prevented from sliding against each other under a torsional load applied to the intermediate support member 80.

Figure 13:
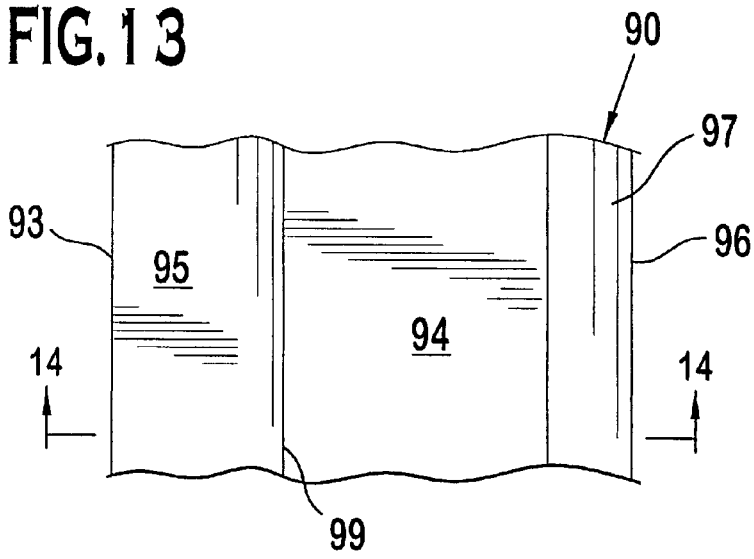
FIG. 13 shows a partial front view of a fourth alternate support blade structure.
Figure 14:
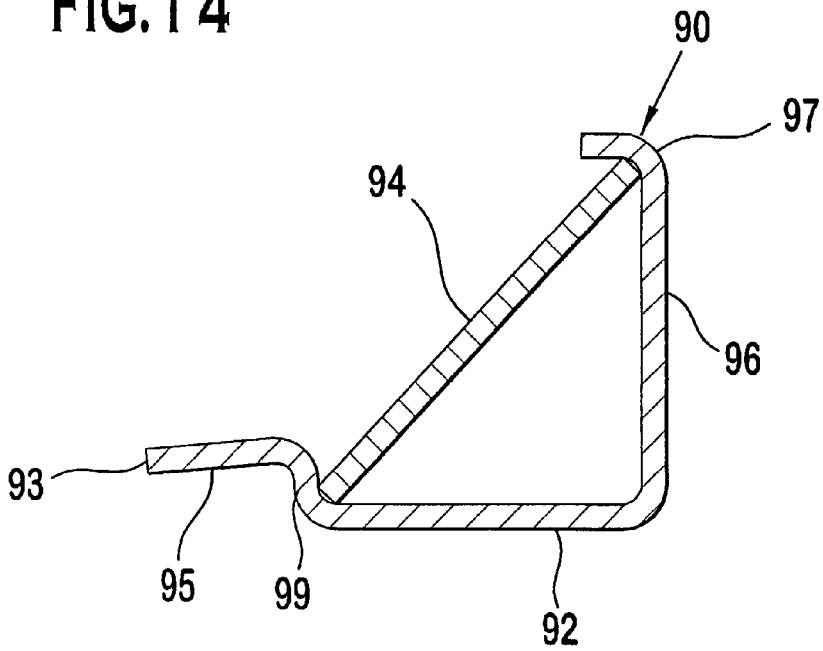
FIG. 14 is a cross sectional view of the fourth alternate support blade structure.

FIGS. 13 and 14 show a fourth alternate embodiment of an intermediate support member 90. This fourth alternate intermediate support member 90 is similar in that it has a side wall 92, a rear side wall 96, and an extended portion 95 extending along the side wall 92. A back wall 94, is a separate member, extends between side walls 92, 96, and is secured to the side wall 92 in yet another manner. Here, the back wall 94 does not have tabs formed along its edges like the embodiment of FIGS. 3–6. A first ridge 99 is formed in the side wall 92 just beneath the extended portion 95. A second ridge 97 is formed in the rear side wall 96 near it's free end. Both ridges 97, 99 preferably extend along the entire length of the intermediate support member 90. It should be understood, that these ridges 99, 97 may alternatively be punched ridge portions as shown in the other embodiments. It should also be understood that the back wall 94 may optionally have tabs formed therein for interlocking between selected optional punched ridge portions as shown in the embodiment of FIG. 11. This fourth alternate intermediate support member 90 is assembled by first forming either ridge 97 or ridge 99 and then inserting the back wall 94. The other ridge 97, 99 is then formed to secure the back wall 94 to the side walls 92, 96 to complete the intermediate support member 90. Alternatively, the ridges 97 and 99 may be formed so as to allow the back wall 94 to be urged therebetween and snap in place to form the closed tubular intermediate support member 90. The fourth alternate intermediate support member 90 is similarly secured to the frame 20 and similarly receives the shadow mask 30 along the mask receiving edge 63.

An advantage of the present invention is that a closed tubular structure is formed as an intermediate support member without the need for welding along the structure. This results in significant savings in manufacturing costs and reduces the time and material required for creating such a structure.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An intermediate support member for receiving a tension mask and for mounting on a frame inside a picture tube comprising:

a first side wall;

a second side wall extending from the first side wall;

a back wall extending from the second side wall and having a plurality of tabs formed along an edge; and, a plurality of apertures extending along at least a portion of the first side wall for receiving the tabs to form a closed structure.

2. The intermediate support member of claim 1 further comprising an extended portion extending from said first side wall and having a tension mask receiving edge, whereby said tension mask assist in urging said first side wall toward said back wall.

3. The intermediate support member of claim 1 wherein the first side wall, the second side wall, and the back wall are formed from one piece.

4. The intermediate support member of claim 1 wherein the plurality of apertures are formed on a ridge.

5. The intermediate support member of claim 1 wherein the support member has a substantially triangular cross-section.

6. A unitary intermediate support member for receiving a tension mask and for mounting on a mask frame for a cathode ray tube comprising:

a first side wall;

a second side wall extending from the first side wall;

a back wall extending from the second side wall; and, a ridge extending along at least a portion of the first side wall, said back wall having an end secured by the ridge forming a closed structure formed from one piece, the ridge comprises a plurality of punched portions forming a plurality of apertures.

7. The unitary intermediate support member of claim 6 wherein the back wall further comprises a plurality of tabs each fitting into a respective aperture between punched portions.

8. The unitary intermediate support member of claim 6 wherein at least one side wall has a tension mask receiving edge.

9. The unitary intermediate support member of claim 6 wherein the closed structure is substantially triangular in shape.

10. A mask frame assembly having a support member for a CRT, the support member comprising:

a first side wall, a second side wall an a back wall forming a substantially triangular closed channel therebetween, each of the side walls further comprising a ridge extending along at least a portion of the side wall, the back wall having distal edges secured to the side walls by being positioned under both of the ridges.

11. A mask frame assembly of claim 10 wherein at least one of the side walls has a tension mask receiving edge.

12. A mask frame assembly of claim 10 wherein the first side wall, the second side wall, and the back wall are made of the same material.

13. A CRT having a funnel sealed at one end to a faceplate panel with a luminescent screen on an interior surface thereof, a mask frame assembly supported within the CRT proximate to the screen having a mask, the mask frame assembly having a support member comprising:

a first side wall, a second side wall extending from the first side wall, and a back wall extending from the second side wall to form a closed structure therebetween; and, at least one of the side walls having an extended portion with a tension mask receiving edge wherein the tension mask assists in urging the at least one side wall toward the back wall, the back wall has a plurality of tabs that are received in apertures formed in at least one of the side walls to interconnect the closed structure.

14. The CRT of claim 13 wherein the first side wall, the second side wall, and the back wall are formed from one piece.

15. The CRT of claim 13 wherein at least one of the side walls has a ridge for securing an end of the back wall to interconnect the closed structure.

* * * * *